United States Patent [19]

Ivanov et al.

[11] Patent Number: 4,616,604

[45] Date of Patent: Oct. 14, 1986

[54] STATOR-ROTOR PISTON INTERNAL COMBUSTION ENGINE

[76] Inventors: Borislav Ivanov; Raina Ivanova, both of Stephan-Born-Str. 1, 6200 Weisbaden, Fed. Rep. of Germany

[21] Appl. No.: 548,863

[22] PCT Filed: Sep. 28, 1983

[86] PCT No.: PCT/EP83/00249

§ 371 Date: Oct. 17, 1983

§ 102(e) Date: Oct. 17, 1983

[87] PCT Pub. No.: WO85/01548

PCT Pub. Date: Apr. 11, 1985

[51] Int. Cl.[4] ..... F02B 75/22

[52] U.S. Cl. ..... 123/55 AA

[58] Field of Search ..... 123/55 R, 55 A, 55 AA, 123/197

[56] References Cited

U.S. PATENT DOCUMENTS

| | | | |
|---|---|---|---|
| 2,264,648 | 12/1941 | Tebaldi | 123/55 R |
| 2,404,752 | 7/1946 | Schoenfeld et al. | 74/389 |
| 3,561,416 | 2/1971 | Kiekhaefer | 123/DIG. 8 |

FOREIGN PATENT DOCUMENTS

| | | | |
|---|---|---|---|
| 464085 | 4/1946 | Belgium . | |
| 745820 | 5/1933 | France | 123/55 A |
| 928485 | 6/1963 | United Kingdom . | |
| 1149988 | 4/1969 | United Kingdom . | |

*Primary Examiner*—Craig R. Feinberg

*Attorney, Agent, or Firm*—Armstrong, Nikaido, Marmelstein & Kubovcik

[57] ABSTRACT

A Stator-Rotor piston internal combustion engine (50) is diclosed having two identical stator halves (5) with an equal number of cylinders in each of them, a flat rotor (6) with two internal gear rings (12) fitted on its periphery and two auxiliary gears (13) sliding on its hubs (14), the rotor (6) being fixed on the engine shaft (7) between both stator halves. Each cylinder is provided with own crankshaft (10) and a drive gear (11) mounted thereon. All drive gears (11) are engaged with the rotor internal gear rings (12) and the auxiliary gears (13) for transmitting the explosion power to the engine shaft (7). As a result of the transmission ratio between the drive gears (11) and the internal gear rings (12) the engine revolutions are reduced in comparison with those of the single crankshafts. For smooth running characteristics of the engine two opposite cylinders explode simultaneously, one of each stator half, and the firing order runs in a circle: 1+3A, 2+4A, 3+1A, 4+2A.

1 Claim, 4 Drawing Figures

SECTION A-A

STATOR-ROTOR PISTON INTERNAL COMBUSTION ENGINE

FIELD OF THE INVENTION

This invention relates to a new Stator-Rotor piston internal combustion engine accomplishing a new method for transmitting the explosion power to the engine shaft, using a new cylinder arrangement in form of two stator halves, and a flat rotor closed in-between, and being mechanically connected with all cylinders. Through increasing the number of cylinders and decreasing the cylinder displacement a general reduction of the compression stress and the power of explosion is achieved, and the already reduced power of explosion is transmitted in a best harmony between cylinder arrangement, kinematics and firing order smoothly to the engine shaft.

REVIEW OF THE PRIOR ART

As it is well known all kinds of piston internal combustion engines have more or less a vibrating run, in a considerable degree due to their cylinder arrangement, mechanical means for transmitting the explosion power, and the relatively great displacement of a single cylinder. This vibrating run affects negatively the engine work and the engine durability.

DEFINITION OF THE INVENTION

In accordance with the present invention there is provided a Stator-Rotor piston internal combustion engine having two mirror-imaged identical stator halves, both halves comprising an equal number of cylinders.

Also in accordance with the present invention there is provided a Stator-Rotor piston internal combustion engine comprising a flat rotor with two internal gear rings fitted on its periphery and two auxiliary gears sliding on its hubs, said rotor being fixed on the engine shaft between both stator halves, two rings mounted internally on the stator halves carrying the internal ends of the single crankshafts, and two engine lids carrying the engine shaft and the outer ends of the single crankshafts.

Further there is provided a Stator-Rotor piston internal combustion engine comprising two mirror-imaged identical stator halves with an equal number of cylinders, each cylinder having, except a conventional piston and a connecting rod, its own crankshaft and a drive gear mounted thereon, all drive gears being engaged with the rotor internal gear rings and the auxiliary gears, thereby transmitting harmoniously the explosion power from all cylinders to the rotor, respectively to the engine shaft.

In Stator-Rotor engine according to the invention all drive gears have equal pitch diameter, said diameter being smaller than the pitch diameter of the internal gear rings causing lower engine revolutions in comparison with those of the single crankshafts. The reduction of the engine revolutions depends on the transmission ratio between the drive gears and the internal gear rings.

The original and compact construction of the engine of this invention allows an alternator, a starter motor, and other engine aggregats to be mounted directly on the outer ends of the single crankshafts. It also allows this engine to be installed in different working positions without disturbing the engine work.

In an engine according to the invention each cylinder of one stator half explodes preferably always together with the one of the other stator half, thus, in each explosion are involved two cylinders contributing to a quiet engine run. To this Stator-Rotor engine construction according to the invention the cylinder firing is preferably set in a circular rotative order to improve further the smooth transmission of the explosion power to the engine shaft.

The invention is not restricted in regard to stroke principle of operation, cooling system, kind of fuel, and can be realized in all known versions in a conventional way.

DESCRIPTION OF THE DRAWINGS

The objects of the invention will be appreciated in more detail by reference to particular preferred embodiments illustrated by the accompanying drawing wherein.

DESCRIPTION OF THE PREFERRED EMBODIMENTS

Figure 1:
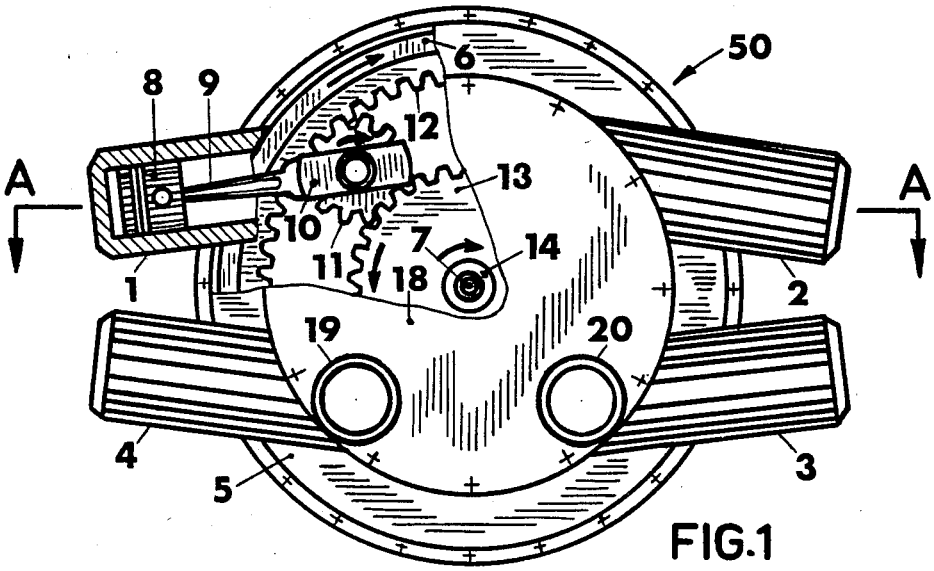
FIG. 1 is a front view of an eight cylinder Stator-Rotor engine which is a first embodiment of the invention.

The Stator-Rotor piston internal combustion engine (50) of the invention illustrated by the drawing comprises two mirror-imaged identical stator halves (5), both of them having an equal number of cylinders, each cylinder has, except a conventional piston (8) and a connecting rod (9), its own crankshaft (10) and a drive gear (11) mounted thereon, a flat rotor (6) with two internal gear rings (12) fitted thereon and two auxiliary gears (13) sliding on its hubs (14), said rotor (6) is fixed on the engine shaft (7) between both stator halves, two rings (15) mounted internally on the stator halves (5) carrying the internal ends (16) of the single crankshafts (10), and two engine lids (18) carrying the engine shaft (7) and the outer ends of the single crankshafts (17). The drive gears (11) are engaged with the rotor internal gear rings (12) and the auxiliary gears (13), the outer ends of the single crankshafts (17) allow different aggregats, for example an alternator (20), a starter motor (19), etc., to be mounted directly thereon. All drive gears (11) have equal pitch diameter which is smaller than the pitch diameter of the internal gear rings (12) and therefore the engine revolutions are reduced in comparison with the revolutions of the single crankshafts. The transmission ratio between the drive gears (11) and the internal gear rings (12) determines the reduction of the engine revolutions.

Figure 3:
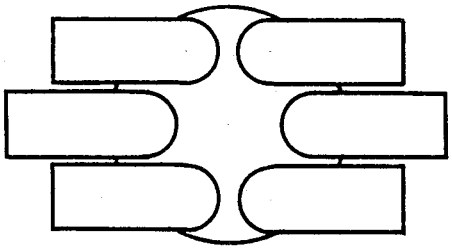
FIG. 3 is a schematic front view of an twelve cylinder Stator-Rotor engine which is a second embodiment of the invention, illustrating an increased number of cylinders.

In FIG. 3 is represented a schematic front view of a Stator-Rotor engine of the invention, particularly showing an increased number of cylinders—visible are the six cylinders of the front stator half, which means a twelve cylinder engine.

Figure 4:
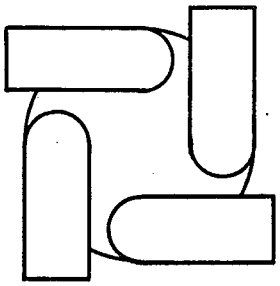
FIG. 4 is a schematic front view of an eight cylinder Stator-Rotor engine which is a third embodiment of the invention, illustrating another cylinder-head arrangement.

FIG. 4 shows a schematic front view of an eight cylinder Stator-Rotor engine of the invention, illustrating particularly another cylinder-head arrangement.

Figure 2:
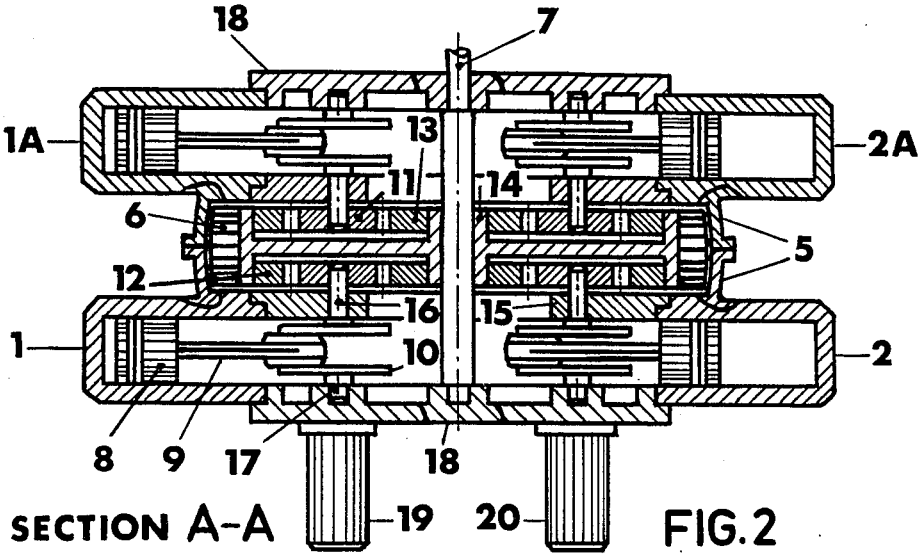
FIG. 2 is a sectional view taken on the line A—A of FIG. 1.

In use the Stator-Rotor engine (50) of the invention is started in a conventional way. In FIGS. 1 and 2 is given an example of an eight cylinder four-stroke engine with a transmission ratio 4:1 between the drive gears (11) and the internal gear rings (12). The starter motor (19) activates the crankshaft (10) of cylinder No. 4 and via its drive gear (11) and the engaged internal gear ring (12) transmits the movement to the rotor (6), respectively to the engine shaft (7). At this moment begins the engine work. Two opposite cylinders simultaneously explode, one of each stator half, and the firing order is set as follows: 1+3A, 2+4A, 3+1A, 4+2A in a circular rotative order to give smooth running characteristics of the engine. The engine revolutions are reduced four times in comparison with the revolutions of the single crankshafts, and per each engine revolution occur eighht double explosions.

Because of its flexible construction with respect to: installed working position, size, number of cylinders, cylinder-head arrangement, rotor diameter, and reduction ratio by the engine revolutions the above described Stator-Rotor piston internal combustion engine could be used for different purposes.

Furthermore there are possibilities to combine a few Stator-Rotor engines with connected engine shafts for locomotive or ship engines. In such cases each engine unit may consist greater number of cylinders and in each explosion may be involved more than two opposite cylinders in order to achieve greater engine output.

I claim:

1. A stator-rotor piston internal combustion engine, comprising:

a pair of mirror-image stator halves having an inner section in abutment and operatively connected to one another;

a plurality of cylinders disposed in an outer section of said stator halves, said stator halves having an equal number of cylinders with one another, each cylinder having, a piston disposed therein, a single connecting rod operatively connected at one end to said piston;

an individual crankshaft for each piston operatively connected to another end of a respective one of said connecting rods, and a drive gear mounted coaxially with each of said crankshafts;

a flat rotor connected to an output engine shaft via a connection means, said rotor being disposed between and within said stator halves;

a pair of internal gear rings surrounded by said rotor, one fixed to each side of said rotor being spaced apart and on opposite sides of said connecting means, said gear rings having gear teeth on a radially inner portion thereof;

a pair of spaced apart auxiliary gears disposed radially inwardly and spaced from said interal ring gears with one of said auxiliary gears on each side of said rotor connecting means and being rotatable with respect to said rotor, said auxiliary gears having gear teeth on an outer periphery thereof, and wherein all of said drive gears have equal pitch diameter with and are spaced apart from one another and are engaged on an outer side thereof with the gear teeth of one of said internal gear rings, and on an inner side thereof with the gear teeth of one of said auxiliary gears, to transmit force from the pistons to the output engine shaft;

a pair of annular plates, one each mounted between each stator half and the rotor adjacent an outwardly facing surface of a respective one of said internal ring gears, each plate having bearing means for supporting internal ends of the crankshafts; and a pair of engine lids, one each mounted on an outer side, away from said rotor, of each stator half, each lid having bearing means for supporting said output engine shaft and outer ends of the crankshafts.

* * * * *